US011060325B2

(12) United States Patent
Kaminsky, Jr.

(10) Patent No.: US 11,060,325 B2
(45) Date of Patent: Jul. 13, 2021

(54) LOCKING SYSTEM FOR DOOR ON OVER-THE-ROAD VEHICLE

(71) Applicant: Robert Joseph Kaminsky, Jr., Homer Glen, IL (US)

(72) Inventor: Robert Joseph Kaminsky, Jr., Homer Glen, IL (US)

( * ) Notice: Subject to any disclaimer, the term of this patent is extended or adjusted under 35 U.S.C. 154(b) by 1102 days.

(21) Appl. No.: 15/450,926

(22) Filed: Mar. 6, 2017

(65) Prior Publication Data

US 2017/0268261 A1 Sep. 21, 2017

Related U.S. Application Data

(60) Provisional application No. 62/303,832, filed on Mar. 4, 2016.

(51) Int. Cl.
*E05B 83/12* (2014.01)
*E05B 67/38* (2006.01)
*E05B 15/16* (2006.01)

(52) U.S. Cl.
CPC ..... *E05B 67/383* (2013.01); *E05B 15/1614* (2013.01); *E05B 83/12* (2013.01); *Y10T 292/34* (2015.04); *Y10T 292/79* (2015.04)

(58) Field of Classification Search
CPC .... E05B 67/383; E05B 15/1614; E05B 83/12; Y10T 292/03; Y10T 292/34; Y10T 292/37; Y10T 292/79
USPC ..... 292/216, 1, 288, DIG. 23; 70/54, 203, 70/211, 212, 417, DIG. 65
See application file for complete search history.

(56) References Cited

U.S. PATENT DOCUMENTS 716,118 A * 12/1902 Scott ..... E05B 5/003 292/1
1,336,505 A * 4/1920 Buggeln ..... E05B 67/383 292/1
2,845,295 A * 7/1958 Clarke ..... E05C 19/08 292/281
3,460,861 A * 8/1969 Armas ..... E05B 67/383 292/281
3,996,774 A * 12/1976 Best ..... E05B 67/36 70/32
4,324,426 A * 4/1982 Michelson ..... E05B 67/38 292/281
4,506,527 A * 3/1985 Grill ..... E05C 19/182 292/295
4,605,251 A * 8/1986 Finlay ..... E05C 19/18 292/147

(Continued)

*Primary Examiner* — Carlos Lugo
(74) *Attorney, Agent, or Firm* — Wood, Phillips, Katz, Clark & Mortimer

(57) ABSTRACT

In combination: an over-the-road vehicle with a frame bounding a cargo space and at least one door having inside and outside surfaces and a peripheral edge; and a first locking assembly connected to the vehicle. The first locking assembly extends in an inside to outside direction over at least a portion of the thickness dimension of the peripheral door edge and so that a first portion extends to beyond the outside door surface. The first portion of the first locking assembly is configured to be engaged by a locking device that acts between the first locking assembly and another component to maintain the first door in the closed position. The first locking assembly is configured so that a region of the first portion is locally strengthened in a manner to resist severance and/or bending.

11 Claims, 7 Drawing Sheets

(56) References Cited

U.S. PATENT DOCUMENTS 4,623,180 A * 11/1986 Zimmerly ..... E05C 17/365 292/264
4,938,041 A * 7/1990 O'Gara ..... E05B 67/383 70/33
4,949,560 A * 8/1990 Anderson ..... E05B 67/38 70/54
4,958,868 A * 9/1990 Watrous, Jr. ..... E05C 19/184 292/258
5,080,354 A * 1/1992 McDougall ..... E05C 1/04 292/145
5,127,244 A * 7/1992 Myers ..... E05B 67/36 70/14
5,267,461 A * 12/1993 Eizen ..... E05B 15/1614 70/417
5,819,561 A * 10/1998 Blehi, III ..... E05B 67/36 70/14
6,233,984 B1 * 5/2001 Blehi, III ..... E05B 13/002 70/2
6,698,805 B2 * 3/2004 Erices ..... E05B 77/04 292/201
6,915,670 B2 * 7/2005 Gogel ..... E05B 13/001 70/32
7,455,336 B2 * 11/2008 Baumchen ..... B60N 2/01541 292/216
7,648,180 B2 * 1/2010 Petry ..... E05B 9/002 292/137
8,132,832 B2 * 3/2012 Anderson ..... E05B 15/0205 292/340
8,245,546 B2 * 8/2012 Olsson ..... E05B 67/38 70/14
8,347,661 B2 1/2013 Kaminsky, Jr.
8,347,662 B2 1/2013 Kaminsky, Jr.
8,381,554 B2 * 2/2013 Senn ..... E05B 67/383 70/56
8,496,276 B2 * 7/2013 Kaminsky, Jr. ..... E06B 1/52 292/216
8,757,684 B2 6/2014 Kaminsky, Jr.
9,021,676 B2 5/2015 Kaminsky, Jr.
2005/0127689 A1 * 6/2005 Tang ..... E05C 19/18 292/288
2005/0252257 A1 * 11/2005 Woods ..... E05B 67/04 70/33

* cited by examiner

LOCKING SYSTEM FOR DOOR ON OVER-THE-ROAD VEHICLE

CROSS-REFERENCE TO RELATED APPLICATIONS

This application claims priority of Provisional Ser. No. 62/303,832, filed Mar. 4, 2016, entitled "Improved Locking System", the disclosure of which is hereby incorporated by reference in its entirety.

BACKGROUND OF THE INVENTION

Field of the Invention

This invention relates to locking systems for doors on over-the-road vehicles and, more particularly, in one form, to a locking system that has a locking assembly on the door to cooperate with a locking device usable to maintain the door in a closed position.

Background Art

The inventor herein has made numerous developments related to securement of one or more doors on over-the-road vehicles. Commercial products incorporating these developments have been highly successful and sales continue to increase in the U.S. and elsewhere.

One product feature is the securement of locking assemblies to doors in a manner whereby the locking assemblies extend over the peripheral edges of the doors and project outwardly therefrom to define a portion that is exposed to accept a locking device, as in the form of a "puck lock". The locking assemblies, typically constructed as formed plates, are maintained in place in a manner that does not require fasteners extending through the exposed external door surfaces. This obviates the need to use conventional hasps that are unsightly, tend to corrode, compromise the exposed layer of the door, and remain readily accessible to potentially be removed or altered by thieves in a manner whereby the associated door might be opened.

These locking assemblies may be configured so that the puck lock overlies that portion of each locking assembly that projects outwardly from the peripheral edge region. While the system may be designed so that the puck lock surface confronting the door is in close proximity to the exposed surface thereof, the construction may be such that a slight gap exists to facilitate placement of the puck lock.

The commercial versions of the locking assemblies/plates are made with metal materials that are highly resistant to tampering, as by cutting or bending. Also, the option exists that the plates might be made with very hard metals or metals that are hardened using conventional treatment processes.

However, in the interest of simplifying manufacturing, and reducing manufacturing costs, it may be desirable to use softer and/or thinner stock that lends itself to bending, as to facilitate locking assembly/plate formation. This may make the design more vulnerable to tampering by an aggressive thief attempting to operate in the slight gap between the puck lock and the exposed outer surface of the door.

While the current commercial products being offered are highly secure, it is always desirable to offer alternative forms that might be made more efficiently or cheaply and that afford the same level of security.

SUMMARY OF THE INVENTION

In one form, the invention is directed to the combination of an over-the-road vehicle and a first locking assembly. The over-the-road vehicle has a frame bounding a cargo space and at least one door that is movable between closed and open positions to selectively block and allow access to the cargo space. The at least one door includes a first door with inside and outside surfaces and a peripheral edge having a thickness dimension between the inside and outside surfaces. The first locking assembly extends in an outside to inside/inside to outside direction over at least a portion of the thickness dimension of the peripheral edge and so that a first portion of the first locking assembly extends to beyond one of the inside and outside surfaces of the first door. The first portion of the first locking assembly is configured to be engaged by a locking device that acts between the first locking assembly and another component on the vehicle to maintain the first door in the closed position. The first locking assembly is configured so that a region of the first portion of the first locking assembly is locally strengthened in a manner to resist severance or bending so as to allow the first door to be moved from the closed position towards the open position to permit access to the cargo space.

In one form, the another component is a second latch assembly on one of: a) the vehicle frame; and b) a second door.

In one form, the locally strengthened region of the first portion of the first locking assembly has a first layer with a first thickness. At least one piece is attached to the first locking assembly so that the locally strengthened region of the first portion of the first locking assembly has an effective combined thickness equal to the first thickness plus a thickness of the at least one piece.

In one form, the at least one piece is made from a material that is more resistant to severance than a material from which the first layer is made.

In one form, the invention is provided in further combination with a locking device that has a secured state wherein a gap is maintained between the locking device and the outside surface of the first door. The locally strengthened region of the first portion of the first locking assembly is exposed through the gap.

In one form, the locally strengthened region of the first portion of the first locking assembly has a first layer with a first thickness. At least one piece is attached to the first locking assembly so that the locally strengthened region of the first portion of the first locking assembly has an effective combined thickness equal to the first thickness plus a thickness of the at least one piece.

In one form, the at least one piece is made from a material that is more resistant to severance than a material from which the first layer is made.

In one form, the first portion of the first locking assembly has an L-shaped portion with a base and a transverse leg. The leg defines an upwardly facing surface. The at least one piece abuts to the upwardly facing leg surface.

In one form, the at least one piece is maintained on the first locking assembly by at least one of: a) an adhesive; b) a braze; c) a weld; and d) frictional forces.

In one form, the first portion of the first locking assembly has a U-shaped portion with a bore and spaced transverse legs. The at least one piece resides between the spaced, transverse legs.

In one form, the at least one piece is made from a hardened material.

In one form, the first portion of the first locking assembly has a first cantilevered tab. The another component has a second cantilevered tab. The first and second cantilevered tabs each has an opening. With the first door in the closed position, the first and second cantilevered tab openings register to receive a part of a locking device.

In one form, the first portion of the first locking assembly has an opening to receive a part of a locking device. The opening extends through the at least one piece.

In one form, the invention is directed to the combination of an over-the-road vehicle, a first locking assembly, and a second locking assembly. The over-the-road vehicle has a frame bounding a cargo space and at least one door that is movable between closed and open positions to selectively block and allow access to the cargo space. The at least one door includes a first door with inside and outside surfaces, and a peripheral edge having a thickness dimension between the inside and outside surfaces. The over-the-road vehicle is configured so that with the first door in the closed position a gap is formed between one portion of the peripheral edge of the first door and one of: a) a second door; and b) the vehicle frame. A first locking assembly is connected to the first door. A second locking assembly is connected to the one of: a) the second door; and b) the vehicle frame. A first portion of at least one of the first and second locking assemblies projects through the gap to beyond the outside surface of the first door to cooperate with a locking device that acts between the first and second locking assemblies to maintain the first door in the closed position. A region of the first portion of at least one of the first and second locking assemblies is locally strengthened in a manner to resist severance or bending so as to allow the first door to be moved from the closed position towards the open position to permit access to the cargo space.

In one form, the second locking assembly is on the vehicle frame.

In one form, the region of the first portion of the at least one of the first and second locking assemblies has a first layer with a first thickness. At least one piece is attached to the at least one of the first and second locking assemblies so that the region of the first portion of the at least one of the first and second locking assemblies has an effective combined thickness equal to the first thickness plus a thickness of the at least one piece.

In one form, the at least one piece is made from a material that is more resistant to severance than a material from which the first layer is made.

In one form, the invention is provided in further combination with a locking device that has a secured state wherein a gap is maintained between the locking device and the outside surface of the first door. The locally strengthened region of the first portion of the at least one of the first and second locking assemblies is exposed through the gap.

In one form, the region of the first portion of the at least one of the first and second locking assemblies has a first layer with a first thickness. At least one piece is attached to the at least one of the first and second locking assemblies so that the region of the first portion of the at least one of the first and second locking assemblies has a combined thickness equal to the first thickness plus a thickness of the at least one piece.

In one form, the first portion of the at least one of the first and second locking assemblies has an L-shaped portion with a base and a transverse leg. The leg defines a surface against which the at least one piece abuts.

In one form, the at least one piece is made from a hardened material.

DETAILED DESCRIPTION OF THE PREFERRED EMBODIMENT

The invention is directed to structures as shown in my U.S. Pat. Nos. 8,496,276 and 8,757,684. Portions of these patents are reproduced hereinbelow with the entire disclosure therein, together with the combined disclosure in my other U.S. Pat. Nos. 8,347,661, 8,347,662, and 9,021,676, incorporated herein by reference.

Figure 1:
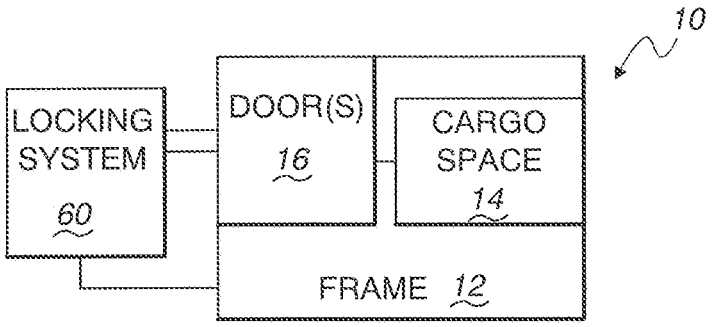
FIG. 1 is a schematic representation of an over-the-road vehicle with the inventive locking system incorporated to maintain at least one door in a closed position.

An over-the-road vehicle is shown at 10 in FIG. 1. The vehicle 10 is shown schematically as it is intended to encompass virtually a limitless number of different vehicle configurations. The vehicle 10 has a frame 12 surrounding a cargo space 14. The frame 12 supports at least one door 16 that is movable between closed and open positions to selectively block and allow access to the cargo space 14. Each door 16 is mounted to the frame 12 for movement between its open and closed positions through various different mechanisms, as by translation or through a pivoting action.

Figure 2:
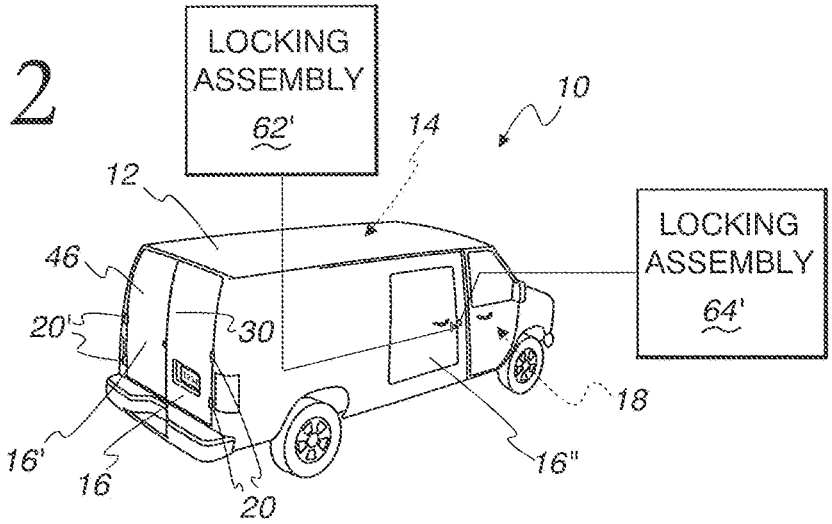
FIG. 2 is a perspective view of one specific form of vehicle with the inventive locking system incorporated and with three separate doors shown in a closed position.
Figure 3:
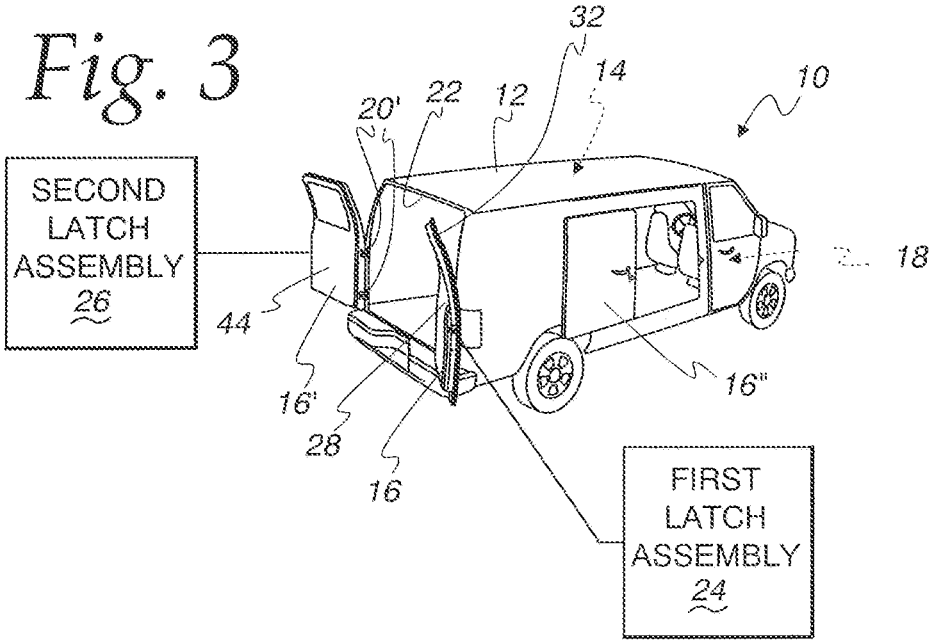
FIG. 3 is a view as in FIG. 2 with each of the three doors in an open position.

One more specific, exemplary form of the over-the-road vehicle 10 is shown in FIGS. 2 and 3 as a conventional van. The frame 12 on the vehicle 10 defines a passenger compartment 18 behind which the cargo space 14 is located.

At the rear of the vehicle 10, first and second doors, 16, 16' are provided and are each connected to the frame 12 by hinges 20, 20' for pivoting movement between closed positions, as shown in FIG. 2, and open positions as shown in FIG. 3. With one or more of the doors 16, 16' in their open position, access to the cargo space 14 can be gained through a framed access opening 22. With the doors 16, 16' in their closed positions, access to the cargo space 14 is blocked by the doors 16, 16'.

The first door 16 has a first latch assembly 24 that cooperates with a second latch assembly 26 on the second door 16' so as to releasably maintain the first and second doors 16, 16' in their closed positions. In FIG. 3, the latch assemblies 24, 26 are shown in schematic form since the particular details of construction are not critical to the present invention. There are currently myriad latch assembly constructions being used on cooperating vehicle doors to releasably maintain the doors in their closed positions.

The first door 16 has an inside 28, an outside 30, and a peripheral edge 32. The first latch assembly 24 consists of a module 34 that is mounted within a space 35 between the inside 28 and outside 30 of the door 16. The module 34 is secured to the door 16 through multiple, and in this case three, fasteners 36, 38, 40. The nature of the fasteners is not critical to the present invention. In this embodiment, each of the fasteners 36, 38, 40 is threaded and directed through the peripheral door edge 32 into the module 34.

The second latch assembly 26 on the second door 16' is mounted on a peripheral edge 42 thereon between the inside 44 and outside 46 of the door 16'. The second latch assembly 26 consists of a strike assembly with a mounting plate 48 and a U-shaped strike element 50 secured thereto.

The second latch assembly 26 is secured to the door 16' by a plurality of, and in this case two, threaded fasteners 52, 54 that are directed through the peripheral edge 42 into fixed, threaded anchoring sockets 56, 57.

With the door 16' in its closed position, the door 16 can be moved from its open position into its closed position, whereupon the strike element 50 moves through a slot 58 in the door 16 into engagement with the module 34 to thereby be releasably held. As noted above, the details of construction for the module 34 are not critical to the present invention. One or more rotors might be used to cooperate with the strike element 50 in conventional fashion. This latched condition for the latch assemblies 24, 26 may be maintained by a conventional locking mechanism, that is not shown in the drawings herein. The locking mechanism may be key actuated and/or actuated from within the cargo space 14.

Releasing of the latch assemblies 24, 26 from each other with the latch assemblies 24, 26 in an unlatched condition allows at least the door 16, and potentially both doors 16, 16', in the event the door 16' is not separately locked from the inside of the cargo space 14, to be moved to their open positions.

To prevent at least the first door 16 from being moved from its closed position into its open position, as in the event unauthorized unlatching and release of the latch assemblies 24, 26 is effected, a locking system is provided at 60, as shown schematically in FIG. 1. The locking system 60 could be the primary locking system or an auxiliary locking system that provides security in the event that the aforementioned locking mechanism fails or is defeated, whereupon the latch assemblies 24, 26 can be separated from each other. The locking system 60 is shown in one specific, exemplary form in FIGS. 2, 3 and 6-12.

Figure 6:
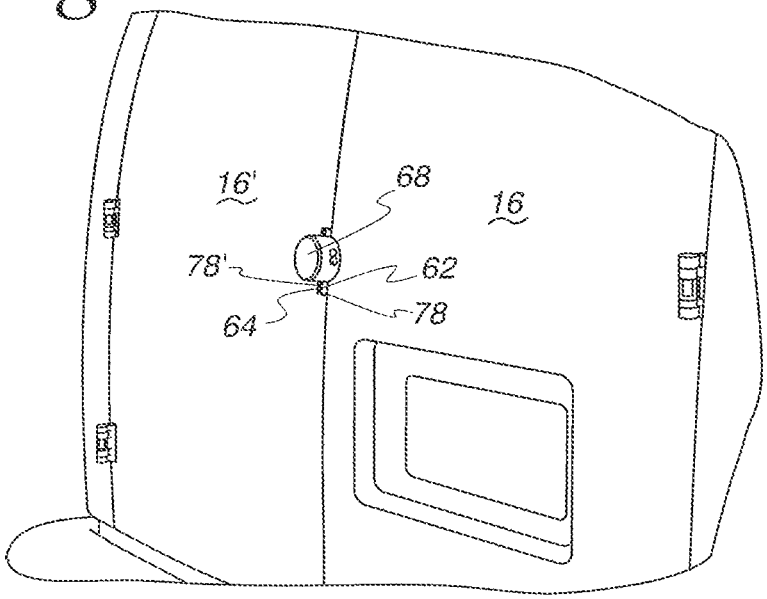
FIG. 6 is an enlarged, fragmentary, perspective view of the rear of the vehicle in FIGS. 2 and 3 with the doors each in a closed position and with a locking device secured to the cooperating locking assemblies.
Figure 7:
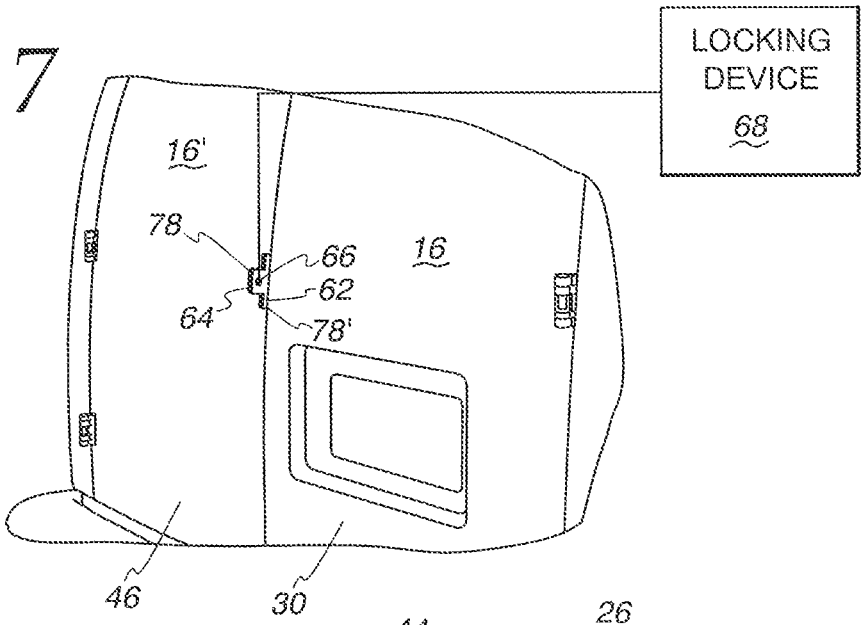
FIG. 7 is a view as in FIG. 6 with the particular locking device removed and with a generic form of locking device depicted.
Figure 8:
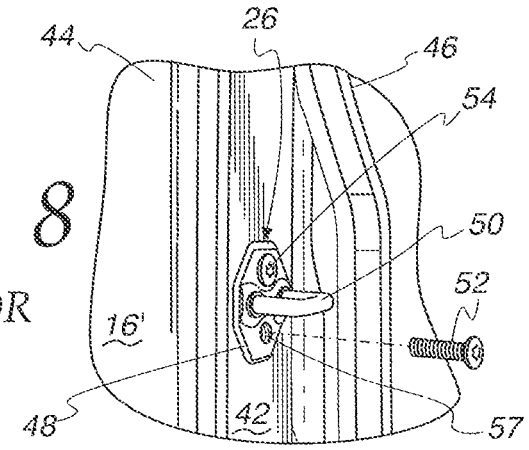
Fig. 8 PRIOR ART
FIG. 8 is an enlarged, fragmentary, perspective view of the latch assembly on one of the doors in FIGS. 6 and 7 and with one of the fasteners holding the latch assembly in place removed.
Figure 9:
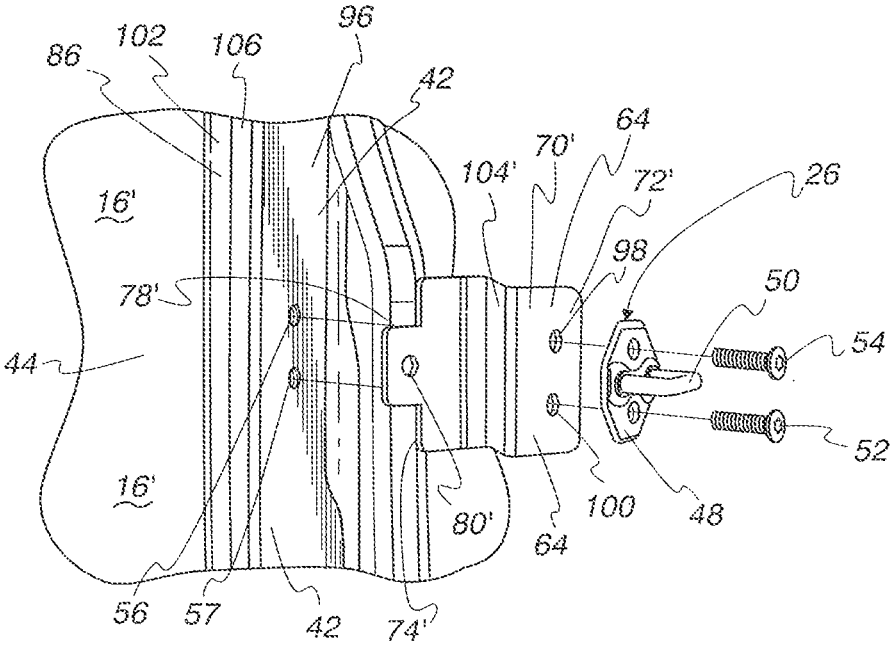
FIG. 9 is a view as in FIG. 8 showing an exploded arrangement of the latch assembly in FIG. 8 and a locking assembly that is captively held between the latch assembly and door.
Figure 10:
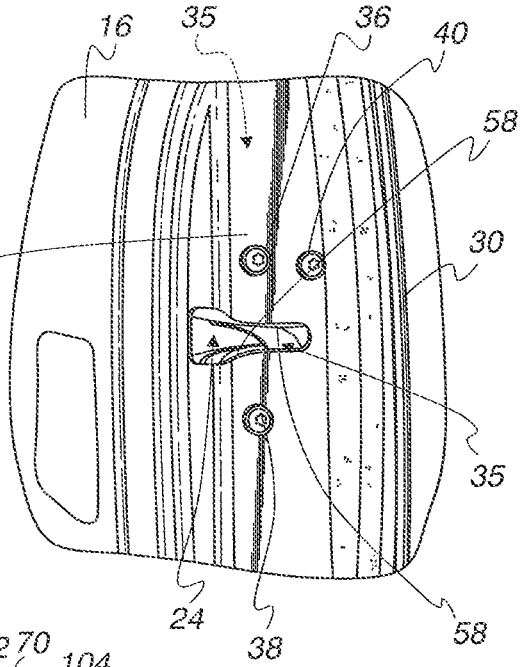
Fig. 10 PRIOR ART
FIG. 10 is an enlarged, fragmentary, perspective view of the latch assembly on the door that cooperates with the latch assembly on the door in FIGS. 8 and 9.

The locking system 60 consists of a first locking assembly 62 on the first door 16 and a second locking assembly 64 on the second door 16'. The first and second locking assemblies 62, 64 are respectively mounted to the peripheral edges 32, 42 of the doors 16, 16' in a manner whereby with the doors 16, 16' in their closed positions, as shown in FIGS. 2, 6 and 7, an opening 66 is defined cooperatively by the locking assemblies 62, 64 through which a locking device 68 can be directed, thereby to maintain the locking assemblies 62, 64 together. In this state, neither of the doors 16, 16' can be moved from its closed position into its open position.

The locking assemblies 62, 64 are preferably secured to their respective doors 16, 16' without structurally modifying the doors 16, 16', other than by addition. More specifically, the locking assembly 62 is secured to the door 16 using the fasteners 36, 38. The locking assembly 62 is in the form of a plate with a body 70 having a main section 72 with a flat surface 74 that facially engages a flat surface 76 on the door peripheral edge 32.

The body 70 has an offset extension 78 with a fully surrounded through opening/bore 80. In one preferred form, the body 70 is defined by a substantially flat piece of stock material that is bent to define the configuration shown with the main section 72 and offset extension 78.

The extension 78 is offset to allow the body 70 to project from the peripheral edge 32 outwardly so that the opening 80 is exposed at a location on the outside of the cargo space 14. With this configuration, the body 70 is allowed to wrap around an edge 82 on the door 16 that projects laterally beyond the flat surface 76 on the peripheral edge 32. Through this arrangement, a lip portion 84, terminating at the edge 82, overlies a complementary seat 86 on the door 16', with the doors 16, 16' in their closed positions. An opening 83 is formed in the body 70 and aligns over the door slot 58 to allow passage of the strike element 50 through the door slot 58 without interference from the body 70.

The body 70 has three additional pre-formed openings/bores 88, 90, 92 that preferably centrally register with the axes of the fasteners 36, 38, 40, respectively. The body 70 is held in place by the fasteners 36, 38 that are used to secure the module 34 to the door 16.

By turning and thereby removing the fasteners 36, 38, these same fasteners 36, 38 can be directed through the openings/bores 88, 90, respectively, to captively secure the body 70 against the peripheral edge 32. With the fasteners 36, 38 removed, the fastener 40 maintains the module 34 fixed in its initial operative position, whereby the fasteners 36, 38 can be readily re-threaded thereinto.

The bore 92 is made to loosely surround the fastener 40 which is not removed or re-used during the assembly process.

Figure 11:
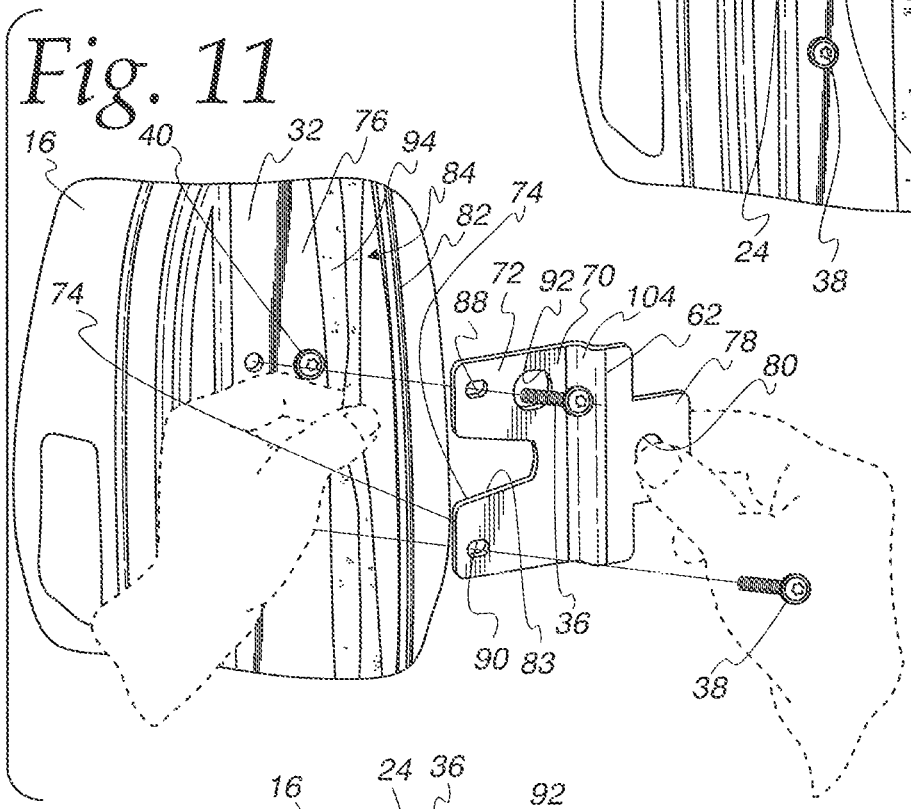
FIG. 11 is a view as in FIG. 10 wherein the latch assembly, which cooperates with the latch assembly in FIG. 9, is being installed on the door in FIG. 10.
Figure 12:
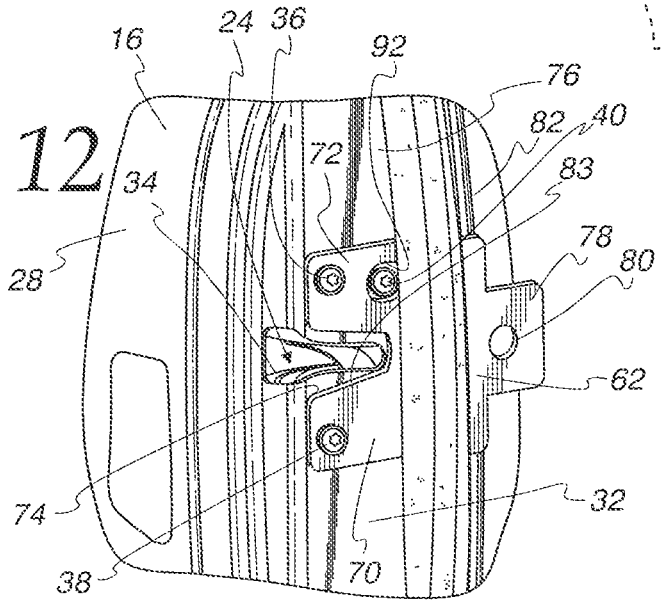
FIG. 12 is a view as in FIG. 11 with the locking assembly secured in place.
Figure 13:
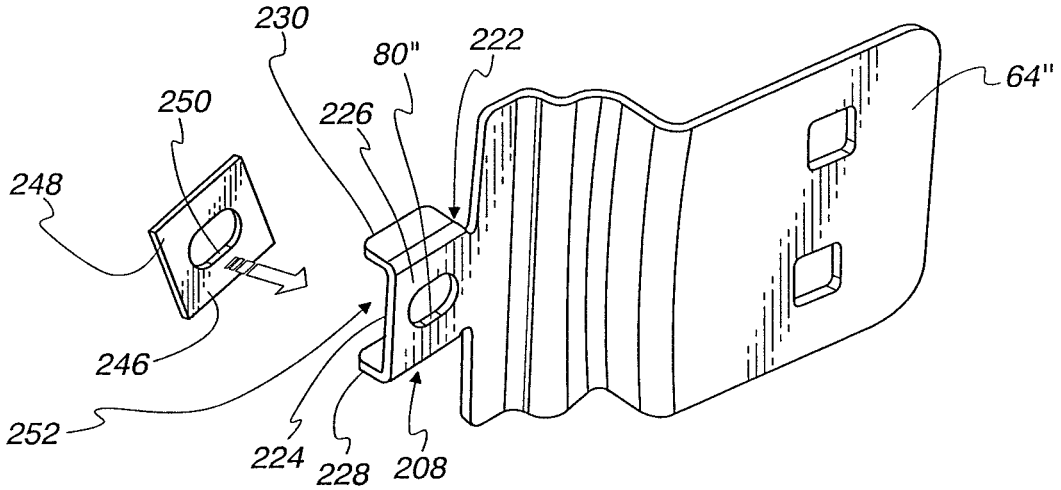
FIG. 13 is an exploded perspective view of a modified form of the locking assembly shown in FIG. 9 and with an associated strengthening piece.

In this door construction, a gasket 94 is mounted at the peripheral edge 32 adjacent to the lip portion 84. During the assembly process for the plate 70, the gasket 94 can be locally separated, slightly away from the remainder of the door 16, to allow the body 70 to be directed between the gasket 94 and peripheral edge 32, as shown in FIG. 11.

The second locking assembly 64 is also in the form of a plate with a body 70' consisting of a main section 72' with a flat surface 74' to be placed facially against a flat surface 96 on the peripheral edge 42 on the door 16'. The body 70' is bent from the main section 72' to define an offset extension 78'. The extension 78' has a fully surrounded opening/bore 80'.

The body 70' is mounted to the door 16' using the existing fasteners 52, 54. More specifically, the fasteners 52, 54 are turned to be removed, thereby allowing separation of the second latch assembly 26, consisting of the mounting plate 48 and strike element 50.

The body 70' has openings/bores 98, 100 that centrally align, one each with the threaded anchoring sockets 56, 57, into which the fasteners 52, 54 are threaded. The body 70 can thus be mounted to be positively captively held between the mounting plate 48 and the flat surface 96 on the peripheral edge 42. The offset extension 78' extends to outside of the door 16'. With the doors 16, 16' in their closed positions, the openings/bores 80, 80' register/align to produce the combined opening 66 that accepts the locking device 68.

The bodies 70, 70' have substantially the same overall configuration, with the exception that the bores/openings therein are different in number, size, and location. The offset extensions 78, 78' on the bodies 70, 70' are oppositely bent. With the body 70, the offset extension 78 is designed to wrap around the edge 82 on the door 16. On the door 16', the offset extension 78' resides adjacent a wall portion 102 that is laterally offset from the peripheral edge 42.

A transition region 104 on the body 70, between the main section 72 and offset extension 78, is situated to bear against the lip portion 84 to confine rearward shifting of the body 70 and thereby reinforce the connection of the body 70. The corresponding transition region 104' on the body 70' is confined against forward movement by a facing, forwardly offset surface 106, thereby reinforcing the connection of the body 70'.

While the precise details of the same will not be described hereinbelow, a similar arrangement of locking assemblies 62', 64' may be provided on a door 16" that is translated between a closed position, as shown in FIG. 2, and an open position, as shown in FIG. 3. The locking assemblies 62', 64' are integrated, using existing fasteners (not shown) on cooperating latch assemblies (not shown) on the door 16" and frame 12. With this construction, the locking assemblies 62', 64' cooperate in the same manner as the locking assemblies 62, 64 cooperate to prevent translation of the door 16' from its closed position.

The locking device 68 may take any of a number of different forms, as shown schematically in FIG. 7. In one form, the locking device 68 is in the form of a padlock. Any element that can be directed through the opening 66 and secured against separation will functional adequately.

In FIG. 6, the locking device 68 is shown as a conventional "hockey puck" that can be placed over the adjacent extensions 78, 78', as shown in the FIG. 7 state, to allow a key operated element (not shown) to be extended through the opening 66.

While the locking assemblies 62, 64 are shown to be of a construction such that the opening 66 is provided outside of the cargo space 14, the generic showing in FIG. 1 is intended to encompass a modified construction wherein the extensions 78, 78' project to a location within the cargo space 14 to accept a locking device 68 installed therein.

Figure 4:
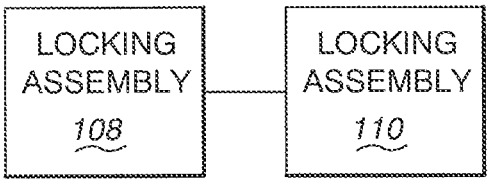
FIG. 4 is a schematic representation of cooperating components making up the inventive locking system.

As shown in FIG. 4, the invention contemplates that the cooperating locking assemblies 62, 64, 62', 64' might be modified significantly from the form shown for the preferred embodiments. The schematic showing of the locking assemblies 108, 110 in FIG. 4 is intended to encompass virtually any cooperating locking assemblies that can be installed without a substantial alteration of the associated doors and that cooperate in any manner to allow their interconnection, either inside or outside of the cargo space 14, to thereby prevent opening of at least one associated door. As just one example, it is not necessary that the locking assemblies 108, 110 have fully surrounded openings/bores to accept a locking device; or that the locking assemblies 108, 110 be in a plate form, as shown for the preferred embodiments. The cooperating locking assemblies 108, 110 may have integrally formed structure through which they are maintained together without any separate locking device.

Figure 5:
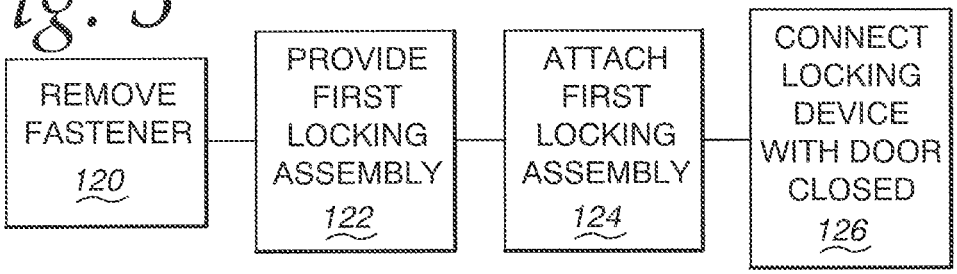
FIG. 5 is a flow diagram representation of a method of preventing a door from being moved from a closed position into an open position, according to the invention.

With the inventive structure, an existing over-the-road vehicle 10 can be retrofit with the locking system 60. The retrofitting method, as shown schematically in FIG. 5, involves the step of removing at least one fastener that maintains a first latch assembly on the first door, as shown at block 120. As shown at block 122, a first locking assembly is provided. As shown at block 124, the at least one removed fastener is used to attach the first locking assembly to the first door. As shown at block 126, a locking device is connected to the first locking assembly and to another part of the vehicle with the door in a closed position, thereby to maintain the first door in the closed position.

The second locking assembly may be installed in a like fashion using existing fasteners.

The locking system 60 may be made up of locking assemblies that have a generic construction capable of adapting to different vehicle models. Alternatively, the locking assemblies may be customized to a particular model and/or make of vehicle.

The openings/bores in the locking assemblies that receive the fasteners may be enlarged/elongated to be certain that the fasteners can be aligned with, and directed into, the appropriate threaded receptacle(s) on vehicle latch assembly components.

In FIGS. 13-16, a modified form of the locking assembly 64" is shown, usable together with the locking assembly 62. The locking assembly 64" has the same basic configuration as the locking assembly 64 and differs primarily in the configuration of a first portion 208 that, with the locking assembly 64" in a mounted position, extends to beyond one of the inside and outside door surfaces 210, 212. In this embodiment, the first portion 208 extends to beyond the outside surface 212. As explained above, it is contemplated that the locking assembly 64", which extends over at least a portion of the thickness dimension of the peripheral door edge 42, projects from the door 16' in an outside to inside or inside to outside direction so that the first portion 208 can be used to effect locking of the door 16' from either an inside or outside location. In the exemplary form described herein, the first portion 208 extends to beyond the outside surface 212.

The locking assembly 62 can be mounted to cooperate with the locking assembly 64" for inside or outside operation and as shown extends over at least a portion of the thickness dimension of the peripheral edge 32 in an inside to outside direction so that a first portion 214 thereof extends to beyond the outside surface 216 of the door 16.

The first portions 208, 214 are configured to be engaged by the locking device 68 that acts between the locking assemblies 62, 64" to maintain the doors 16, 16' in closed positions. More specifically, the first portion 208 has an opening 80" that is registrable with the opening 80 on the first portion 214.

With the doors 16, 16' closed, a bolt 218, controllable through a key 220, can be advanced through the registered openings 80, 80" with the locking device 68 in place and changed into a locked state.

The projecting region at 222 on the first portion 208 is in the form of a cantilevered tab 224. The tab 224 has a "U" shape, as viewed from a front perspective (see FIG. 15), with a rectangular base 226 and spaced, legs 228, 230 that are bent orthogonally to the base 226.

Figure 14:
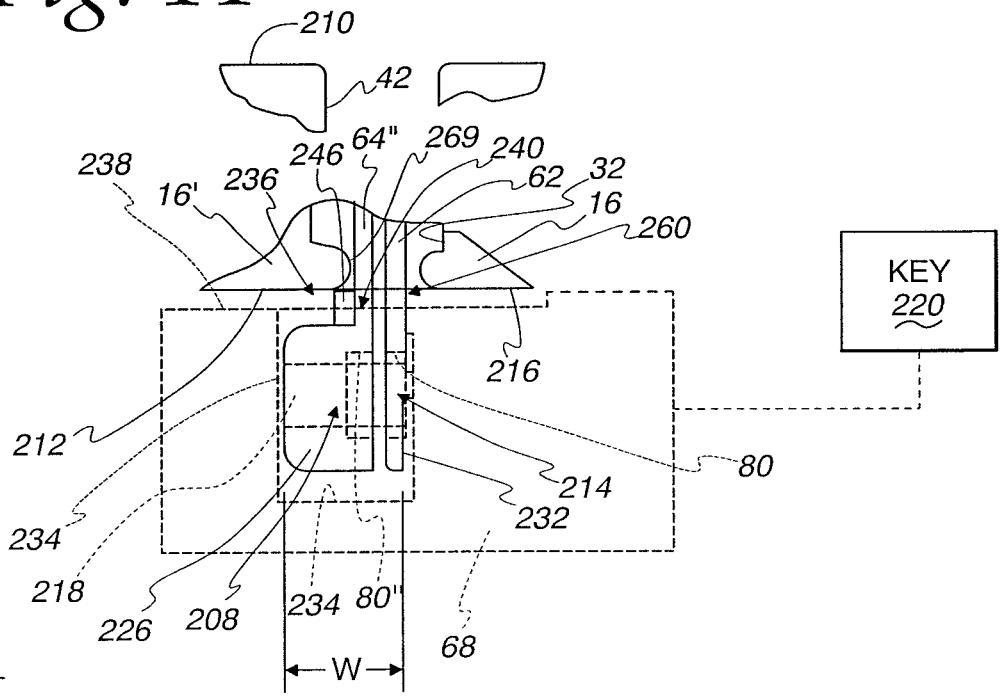
FIG. 14 is a fragmentary plan view of the vehicle doors in the FIG. 6 state with the locking assembly in FIG. 13 incorporated and with the locking device shown in dotted lines.
Figure 15:
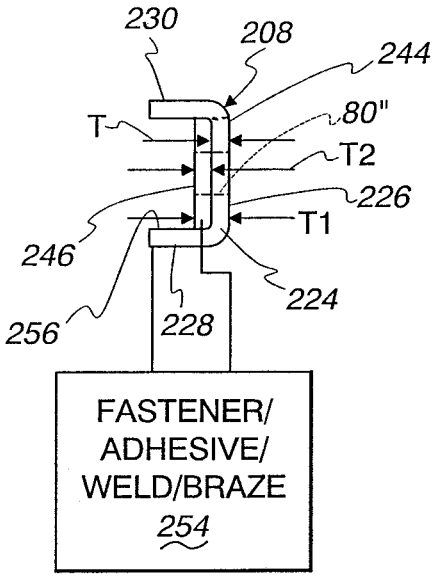
FIG. 15 is a partially schematic, fragmentary, front elevation view of the components in FIG. 14.
Figure 16:
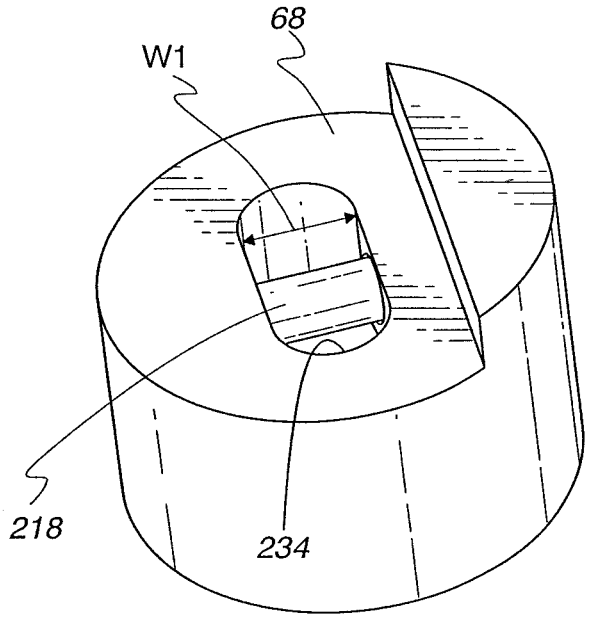
FIG. 16 is a rear perspective view of the locking device shown in FIG. 14.

With the doors 16, 16' closed, the tab 224, and a corresponding tab 232 on the first portion 214 of the locking assembly 62, occupy a combined width W, as viewed in plan in FIG. 14, that is slightly less than the width W1 of a blind cavity 234 in the locking device 68 into which the tabs 224, 232 extend with the locking device 68 pressed into the operative position, as shown in dotted lines in FIG. 14. Once in that position, the key 220 can be operated to advance the bolt 218 through the cavity 234 and the registered openings 80, 80".

The legs 228, 230, by increasing the effective width of the tab 224, in addition to rigidifying the tab 224, serve to facilitate consistent location of the tabs 224, 232 within the cavity 234 to cause alignment of the openings 80, 80" with the path of the bolt 218.

With the locking device 68 in place and in a locked state, a slight gap is maintained at 236 between a back surface 238 of the locking device 68 and the outside surfaces 212, 216 of the doors 16', 16, respectively.

To minimize the success of tampering with the system by accessing the tabs 224, 232 through the gap 236, a region 240 of the first portion 208 of the locking assembly 64", and particularly that portion exposed through the gap 236, is locally strengthened in a manner to resist severance and/or bending of the region 240 whereby the system might be defeated so as to allow the door 16' to be moved from its closed position towards its open position to permit unauthorized access to the cargo space 14.

Figure 17:
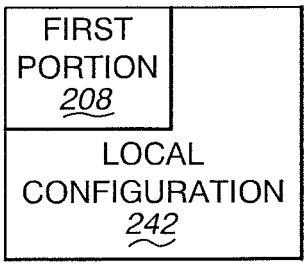
FIG. 17 is a schematic representation of structure for locally strengthening a portion of a locking assembly, of the type shown in FIG. 13.

While a specific structure will be described in FIGS. 13-16 to effect local strengthening of the region 240, the invention contemplates virtually an unlimited number of different local configurations of the region 240, as shown generically at 242 in FIG. 17. By locally strategically forming the first portion 208 to enhance its integrity and resistance to severance and/or bending, the need to make the entire locking assembly 64" of a heavier gauge, more expensive, or hardened, material may be obviated.

As depicted in FIGS. 13-16, the first portion 208 is made with a layer 244 having a substantially uniform thickness T. At least one piece 246 is attached to the locking assembly 64" at the region 222 so that the region at 222 has an effective combined thickness T1 equal to the thickness T of the layer 244 plus the thickness T2 of the piece 246.

While a single piece 246 is shown, multiple pieces could be employed. As depicted, the piece 246 has a generally rectangular body 248 with an elongate opening 250 therethrough. In the form shown, the piece 246 nests within the "U" defined by the base 226 and legs 228, 230. Preferably, the piece 246 extends rearwardly up to the outside surface 212 or at least into close proximity therewith. In an alternative form, the piece 246 can extend rearwardly past the outside surface 212.

The piece 246 may be maintained in place by a number of different means. In one form, the piece 246 can be squeezed into the space at 252 bounded by the "U" between the legs 228, 230 so as to be held in place by frictional forces. Alternatively, as shown schematically in FIG. 15, the piece 246 may be joined to the tab 224 by a fastener, adhesive, a weld, or a braze 254. Local hardening of the plate material at the region 240 is also an option. Other configurations involving joining of separate pieces are also contemplated within the generic showing of FIG. 17.

The opening 250 may be made larger than the openings 80, 80" to avoid any possible interference with the movement of the bolt 218 through the registered openings 80, 80" when effecting locking of the device 68.

It is contemplated that the piece 246, or a like piece or multiple pieces, might be used on the locking assembly 64 in its earlier described form. Conceptually, it performs the same function. However, the modified form of locking assembly 64" makes retention of the piece 246 easier by providing an upwardly facing ledge 256 that supports the piece 246. Aggressive securement may thus be unnecessary. For example, a single spot of adhesive might suffice to maintain each piece 246 in place. In a more basic form, the leg 230 could be eliminated, as indicated in dotted lines in FIG. 15, whereby the tab 224 has an "L" shape defined by the leg 228 and base 226, as viewed from the front perspective of FIG. 15. This may afford the desirable vertical support for the piece(s) 246.

While the piece 246 is shown to abut to the base 226, this is not a requirement. Any mounting that allows alignment of the openings 80, 80", 250 and that causes the piece 246 to increase the combined thickness dimension T1, would suffice.

By reason of increasing the effective thickness of the base 226 in the region 240, resistance to severance and bending of the tab 224 is increased, regardless of the material utilized. Thus, the same material might be used to make the tab 224 and the piece 246.

Alternatively, a harder material might be utilized. Steel and titanium are suitable exemplary materials. In an alternative form, the piece 246 may be treated to effect hardening to thereby increase its resistance to severance and bending.

Figure 18:
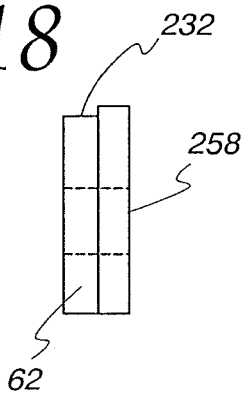
FIG. 18 is a fragmentary, front elevation view of the locking assembly, cooperating with the locking assembly as shown in FIG. 13, and with a strengthening piece attached.

As shown in FIG. 18, a piece 258, generally the same as the piece 246, can be attached to the tab 232 on the locking assembly 62 to strengthen the resistance to severance and bending of the region at 260 (FIG. 14) of the first portion 214 that is exposed through the gap 236 with the locking device 68 in place and in a locked state.

Figure 19:
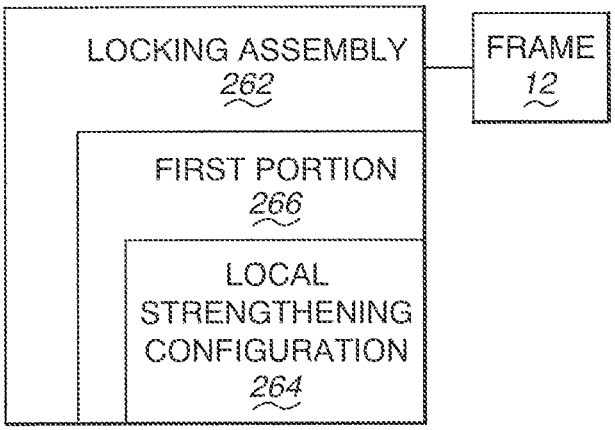
FIG. 19 is a schematic representation of a locking assembly with localized strengthening according to the present invention and attached to a vehicle frame.

While the local strengthening of the locking assembly has been described above with respect to locking assemblies on the doors 16, 16', as shown schematically in FIG. 19, it is also contemplated that a locking assembly 262 on the vehicle frame 12, configured to cooperate with a locking assembly on a movable door—slidable or hinged—might have a corresponding local strengthening configuration 264 on a first portion 266.

With all embodiments, it is contemplated that either or both of the cooperating locking assemblies might include the local strengthening configuration that increases resistance to severance and/or bending that might occur in the absence of such a local modification.

Figure 20:
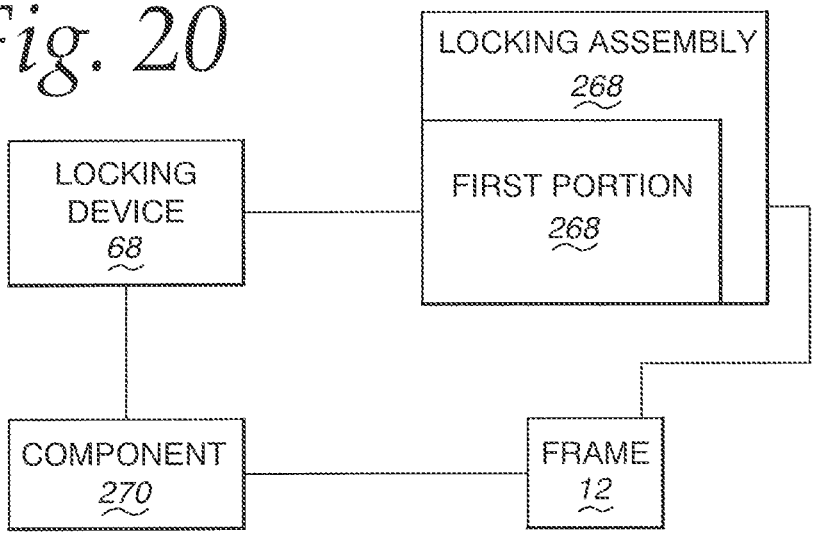
FIG. 20 is a schematic representation of a vehicle door locking system incorporating a locking assembly strengthened according to the present invention.

Still further, as shown schematically in FIG. 20, the inventive concepts described above can be incorporated into any locking assembly 268, connected directly or indirectly to the vehicle frame 12, with a first portion 268 projecting through a gap at a door edge, such as the gap 269 shown in FIG. 14, and designed to be maintained in a predetermined relationship with another component 270 on the frame 12 through the locking device 68 to thereby maintain one or more doors in a closed position.

A desirable feature of the inventive structure is the ability to provide locking assembly portions that can be engaged by the locking device 68 without requiring direction of fasteners through exposed outside surfaces of the doors 16, 16', or any other modification of such surfaces.

The locking assembly parts 246 may be made from steel, titanium, or the like, or a hardened metal material so that they are not prone to being cut or otherwise altered to defeat the locking system.

The foregoing disclosure of specific embodiments is intended to be illustrative of the broad concepts comprehended by the invention.

The invention claimed is:

1. In combination:

an over-the-road vehicle comprising a frame bounding a cargo space and at least one door that is movable between closed and open positions to selectively block and allow access to the cargo space, the at least one door comprising a first door with inside and outside surfaces, and a peripheral edge having a thickness dimension between the inside and outside surfaces;

a first locking assembly connected to the over-the-road vehicle, the first locking assembly extending in an outside to inside/inside to outside direction over at least a portion of the thickness dimension of the peripheral edge and so that a first portion of the first locking assembly extends to beyond one of the inside and outside surfaces of the first door in one of an outside to inside/inside to outside direction; and a locking device having a cavity into which a part of the first portion of the first locking assembly can be directed, the first portion of the first locking assembly and the locking device configured so that with the part of the first portion of the first locking assembly directed into the cavity, and the first door in the closed position, the locking device can be changed from an unlocked state into a locked state wherein the locking device acts between the first locking assembly and another component on the vehicle, related to the first locking assembly, to maintain the first door in the closed position, wherein with: a) the first door in the closed position; b) the part of the first portion of the first locking assembly directed into the cavity; and c) the locking device in the locked state, a gap is maintained between the locking device and outside surface of the first door, wherein the part of the first portion of the locking assembly has an L-shaped portion with a base and a first transverse leg, the leg defining an upwardly facing surface, wherein the combination further includes at least one piece supported on the upwardly facing surface and projecting beyond the L-shaped portion and into the gap to thereby locally strengthen a region of the first portion of the first locking assembly so as to thereby resist severance or bending of the first portion of the first locking assembly exposed through the gap as might permit the first door to be moved from the closed position towards the open position to permit access to the cargo space.

2. The combination according to claim 1 wherein the another component is a second latch assembly on one of: a) the vehicle frame; and b) a second door.

3. The combination according to claim 1 wherein the locally strengthened region of the first portion of the first locking assembly comprises a first layer with a first thickness and the at least one piece is attached to the first locking assembly so that the locally strengthened region of the first portion of the first locking assembly has an effective combined thickness equal to the first thickness plus a thickness of the at least one piece.

4. The combination according to claim 3 wherein the at least one piece is made from a material that is more resistant to severance than a material from which the first layer is made.

5. The combination according to claim 3 wherein the at least one piece is made from a hardened material.

6. The combination according to claim 3 wherein the first portion of the first locking assembly has an opening to receive a part of the locking device and the opening extends through the at least one piece.

7. The combination according to claim 1 wherein the at least one piece is exposed through the gap.

8. The combination according to claim 1 wherein the first portion of the first locking assembly has a second transverse leg, the first and second transverse legs and base cooperatively defining a "U" shape.

9. The combination according to claim 8 wherein a bore is formed through the first and second transverse legs through which a part of the locking device extends within the locking device in the locked state.

10. The combination according to claim 1 wherein the at least one piece is maintained on the first locking assembly by at least one of: a) an adhesive; b) a braze; c) a weld; and d) frictional forces.

11. The combination according to claim 1 wherein the first portion of the first locking assembly comprises a first cantilevered tab and the another component comprises a second cantilevered tab, the first and second cantilevered tabs each having an opening and with the first door in the closed position the first and second cantilevered tab openings register to receive a part of a locking device.

* * * * *